US007783216B2

(12) United States Patent
Hayami et al.

(10) Patent No.: US 7,783,216 B2
(45) Date of Patent: Aug. 24, 2010

(54) IMAGE FORMING APPARATUS HAVING TRANSFER DEVICE

(75) Inventors: Toshiki Hayami, Hachioji (JP); Satoshi Nishida, Saitama (JP); Masato Kubota, Hachioji (JP)

(73) Assignee: Konica Minolta Business Technologies, Tokyo (JP)

( * ) Notice: Subject to any disclaimer, the term of this patent is extended or adjusted under 35 U.S.C. 154(b) by 389 days.

(21) Appl. No.: 12/020,995

(22) Filed: Jan. 28, 2008

(65) Prior Publication Data

US 2009/0052919 A1 Feb. 26, 2009

(30) Foreign Application Priority Data

Aug. 22, 2007 (JP) ..... 2007-215688
Aug. 22, 2007 (JP) ..... 2007-215690

(51) Int. Cl.
*G03G 15/16* (2006.01)

(52) U.S. Cl. ..... 399/66

(58) Field of Classification Search ..... 399/66, 399/53, 302, 308, 310, 314, 315, 38
See application file for complete search history.

(56) References Cited

U.S. PATENT DOCUMENTS

| | | | | |
|---|---|---|---|---|
| 4,739,363 | A * | 4/1988 | Hoshika et al. | 399/315 |
| 5,946,538 | A * | 8/1999 | Takeuchi et al. | 399/302 |
| 2003/0228166 | A1* | 12/2003 | Nakagawa et al. | 399/66 |
| 2007/0041756 | A1* | 2/2007 | Akaike et al. | 399/310 |

FOREIGN PATENT DOCUMENTS

| | | |
|---|---|---|
| JP | 2001-154548 | 6/2001 |
| JP | 2004-184984 | 7/2004 |
| JP | 2005-107385 | 4/2005 |
| JP | 2005-115197 | 4/2005 |

OTHER PUBLICATIONS

Japanese Office Action dated Jul. 28, 2009 for Appln. No. 2007-215688.
Japanese Office Action dated Jul. 28, 2009 for Appln. No. 2007-215690.

* cited by examiner

*Primary Examiner*—David P Porta
*Assistant Examiner*—Kiho Kim
(74) *Attorney, Agent, or Firm*—Finnegan, Henderson, Farabow, Garrett & Dunner, LLP

(57) ABSTRACT

An image forming apparatus which forms a toner image, includes: an image carrier which carries the toner image thereon; a transfer section which interposes a transfer member at a transfer nip between the image carrier and the transfer section thereby to transfer the toner image on the image carrier onto the transfer member; a voltage applying member provided downstream of the transfer nip in a moving direction of the transfer member; a power source section which applies a voltage to the voltage applying member; and a control section which controls the voltage applied by the power source section. The control section controls the power source section to apply a prescribed voltage to the voltage applying member so that the prescribed voltage has the same polarity as that of a toner used in the apparatus and the voltage applying member does not carry out a self-discharge to the transfer member.

10 Claims, 8 Drawing Sheets

IMAGE FORMING APPARATUS HAVING TRANSFER DEVICE

This application is based on Japanese Patent Application No. 2007-215688 filed on Aug. 22, 2007, and No. 2007-215690 filed on Aug. 22, 2007, which are incorporated hereinto by reference.

BACKGROUND OF THE INVENTION

The present invention relates to an image forming apparatus of an electrophotography system, particularly relates to an image forming apparatus having a transfer apparatus for transferring a toner image onto a transfer member such as a sheet or an intermediate transfer belt.

In the image forming apparatus of the electrophotography system, the toner image is formed onto a photoreceptor and the formed toner image is transferred onto a sheet. Or in the color image forming apparatus in which a full color output is possible, different toner images are formed respectively onto a plurality of photoreceptors and the formed toner images are sequentially superimposed onto an intermediate transfer member. And the superimposed toner image is secondarily transferred onto a sheet collectively in a secondary transfer section.

In such image formation, the toner image is transferred to a sheet or an intermediate transfer member by having the sheet or the intermediate transfer member (these are hereafter called a transfer member) contact the photoreceptor. When separating the transfer member from the photoreceptor after transferring, there may be a case that an unintentional discharge phenomenon between the toner layers on the photoreceptor and a transfer member may occur. Since the charge of some toners changes by the abnormal discharge when such abnormal discharge occurs, the electrostatic absorption force with the transfer member will decline. Under this effect, the spread of the toner image arises by opposing with a surrounding toner, or a reverse transfer is carried out to the other photoreceptor on the downstream side. These phenomena cause image failures.

FIG. 9 illustrates a schematic diagram explaining the image failure by the abnormal discharge in a tandem type color image forming apparatus. The figure shows the circumference of the intermediate transfer belt 6 of the shape of a belt in a color image forming apparatus. The toner images, each of which has different color, are respectively formed onto a plurality of drum shaped photoreceptors 1. The formed toner image is transferred onto intermediate transfer belt 6 by a transfer roller 7, and is sequentially superimposed.

In the superimposed toner layer, since the total charge amount of the toner and the thickness of the toner layer increase compared to a monolayer toner layer, the absolute value of the toner layer potential rises. In the toner layer, which has been superimposed on the 2nd photoreceptor 1 (M), an exfoliation discharge phenomenon between the toner layer and the photoreceptor 1 by the rise of the toner layer potential is easily generated. When an exfoliation discharge "ed" occurs as shown in the figure, in connection with the discharge phenomenon, the charge amount will change in some toners of the toner layer, and the toner, which has been originally tinged with a negative charge, becomes a toner "pt" having a positive charge depending on the change level. In a photoreceptor 1 (C) located in further downstream, the toner "pt" of the positive charge is reversely transferred "rd" to the photoreceptor 1 (C) by a transfer electric field in a transfer nip N. For this reason, in a portion where the reverse transfer has generated, the amount of the toners will decrease compared to the surrounding, and an image failure will occur.

In order to suppress the abnormal discharge, Unexamined Japanese Patent Application Publication No. 2001-154548 discloses an image forming apparatus having a cleaning discharger, which is arranged to apply alternative bias voltage onto the photoreceptor so as to discharge a part of electric charges generated by the cleaning discharger towards the surface of the transfer member, onto which a toner image has been transferred. Further, Unexamined Japanese Patent Application Publication No. 2005-115197 discloses an image forming apparatus with a discharger which discharges a front surface or a back surface of the intermediate transfer member in the downstream of the transfer position.

According to the image forming apparatus disclosed by Unexamined Japanese Patent Application Publication Nos. 2001-154548 and 2005-115197, in either case, a discharge electrode actively self-discharges to the transfer member to control the electric charge of the toner layer formed on the transfer member in a prescribed range.

However, it is difficult to control the electric charge of the toner layer in the prescribed range. When not charged uniformly, it becomes an uneven charge of the toner layer, and the spread of the toner image resulting from the uneven charge and the image failure by the reverse transfer on the photoreceptor drum on the downstream side will occur.

Unexamined Japanese Patent Application Publication Nos. 2001-154548 and 2005-115197 do not take the potential of the tone layer into consideration. When the absolute value of the toner layer potential is high, the image failure by the abnormal discharge mentioned above tends to occur. In the image forming apparatus disclosed by the above-mentioned patent documents, since discharge is performed uniformly, unnecessary discharge is performed without taking the toner layer potential into consideration, even when the absolute value of toner layer potential is low where the image failure is not generated.

When performing the discharge in case where the absolute value of the toner layer potential is low, it easily becomes a superfluous discharge. When it becomes the superfluous discharge, the image failure resulting from the uneven charge will occur. Thus, when the discharge was uniformly performed regardless of the level of the toner layer potential, problems, such as a new image failure by the unnecessary discharge and a deterioration of the endurance of the discharge electrode and a loss of consumption energy, may arise.

SUMMARY OF THE INVENTION

An object of the present invention is to provide an image forming apparatus, which can suppress the image failure produced from the uneven charge of the toner layer in view of the above-mentioned problem.

Another object of the present invention is to provide an image forming apparatus, which does not generate a new image failure due to an unnecessary discharge, in addition to the above.

An above-mentioned object is attained by an aspect of the present invention described below.

An image forming apparatus for forming an image, includes an image carrier for carrying a toner image, a transfer section for interposing a transfer member in a transfer nip and transferring the toner image onto the transfer member, a voltage applying member arranged in a downstream of a moving direction of the transfer member from the transfer nip, a power source section for applying voltage to the voltage applying member, and a control section for controlling the voltage applied by the power source section, wherein the control section controls the power source section to apply predetermined voltage to the voltage applying member so that the voltage applying member does not carry out self-discharge to the transfer member and the predetermined voltage has the same polarity as toner.

DETAILED DESCRIPTION OF THE PREFERRED EMBODIMENT

Although the present invention is explained based on an embodiment, the present invention is not limited to this embodiment.

Figure 1:
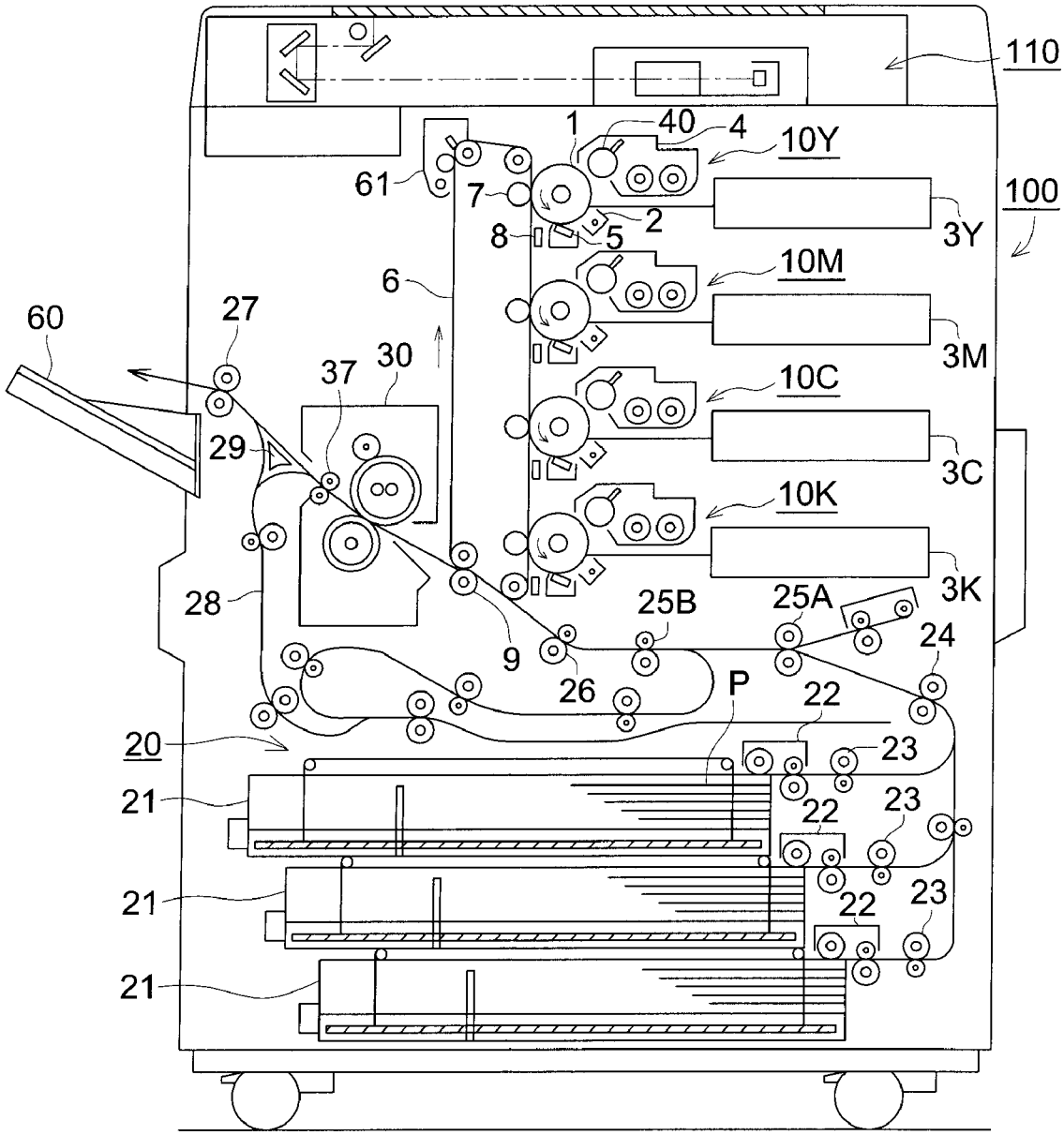
FIG. 1 illustrates the main section of an image forming apparatus related to this embodiment.

FIG. 1 shows the main section of the image forming apparatus related to this embodiment. An image forming apparatus 100 is called a tandem type color image forming apparatus. The image forming apparatus 100 is configured by a plurality of sets of image forming sections 10Y, 10M, 10C, and 10K, an intermediate transfer belt 6, a sheet feeding device 20 and a fixing device 30.

A scanner 110 is installed in the upper portion of the image forming apparatus 100. A scanning exposure to the image of a document is carried out by the optical system of the scanner 110, and the document placed on a document table is read into a line image sensor. The analog signal to which photoelectric conversion has been applied by the line image sensor is inputted to the imagewise exposure units 3Y, 3M, 3C, and 3K after processing of analog processing, an A/D conversion, a shading correction, image compression processing have been performed in the image processing section.

Figure 2:
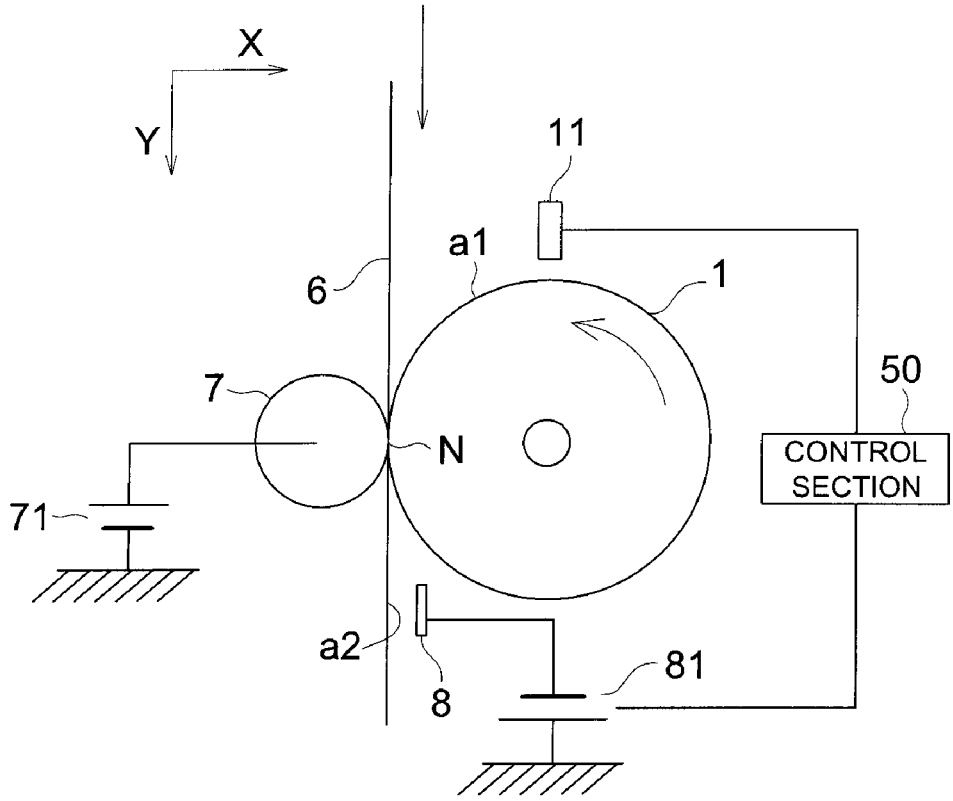
FIG. 2 illustrates an enlarged drawing of a primary transfer roller 7 surrounding.

Numeral 50 shown in FIG. 2 is a control section. The control section is equipped with CPU and memory, and when CPU executes the program stored in the memory, the control section performs various controls.

The image forming section 10Y for forming the toner image of a yellow (Y) color, the image forming section 10M for forming the toner image of a magenta (M) color, the image forming section 10C for forming the toner image of a cyan (C) color and the image forming section 10K for forming the toner image of a black (K) color respectively have a charging unit 2, an imagewise exposure unit 3, a developing unit 4 and a cleaning unit 5 which have been arranged around the drum shaped photoreceptor 1 as an image carrier (a referential mark is omitted for M, C, and K).

A developing apparatus 4 includes two-component developer, which is composed of the carrier and toner of the diameter of a small particle of each different colors of yellow (Y), magenta (M), cyan (C), and black (K). The two-component developer is composed of a carrier having a ferrite as a core, around which insulating resin has been coated, and a toner having polyester as a main material to which coloring agents, such as pigment or carbon black, an electric charge control agent, silica and titanium oxide are added. The particle diameter of the carrier is 10-50 μm. Saturation magnetization is 10-80 emu/g. The particle diameter of toner is 4-10 μm. The charging characteristics of the toner are negative electrified polarity, and are −20 to −60 μC/g as an average electric charge amount. As for the two-component developer, developer made by the mixture of these carriers and toners so that the toner density becomes 4-10 mass % is used.

The developing roller 40 of the developing apparatus 4 disposed opposing to the photoreceptor 1 is configured by an external surface (called a developing sleeve), which is capable of rotating, and a magnet rolls fixed to an internal surface. On the surface of the developing sleeve, a developer layer of which the thickness is uniformly regulated by the developer regulating section, is held. The developer layer is conveyed in the opposite side of the photoreceptor 1 (not shown) with rotation, and is developed by the development electric field with the photoreceptor 1 which it was formed of the power source.

Numeral 6 is an intermediate transfer belt, and is supported by a plurality of rollers so as to be capable of rotating. An intermediate transfer belt 6 is an endless belt having a volume resistivity $10^6$-$10^{12}$ Ω-cm. For example, the intermediate transfer belt is a semiconductive endless belt structured by engineering plastics, such as denaturation polyimide, heat hardening polyimide, an ethylene tetrafluoroethylene copolymer, a polyvinylidene fluoride, and a nylon alloy, to which a conductive material has been distributed. The intermediate transfer belt has the thickness of 0.04-0.10 mm.

The toner image of each color formed on the photoreceptor 1 from the image forming sections 10Y, 10M, 10C, and 10K is primarily transferred one by one with the primary transfer roller 7 on the intermediate transfer belt 6, and a superimposed color toner image is formed. On the other hand, residual toners of the photoreceptors 1 (Y, M, C, K) after transfer are removed by respective cleaning sections 5.

In addition, in an embodiment of the present invention, the intermediate transfer belt 6 functions as "a transfer member", and a plurality of the primary transfer rollers 7 and the intermediate transfer belt function as "a transfer section". And the toner image carried onto the photoreceptor 1 is transferred onto the transfer member in the transfer nip N in between each primary transfer roller 7 and photoreceptor 1 (primary transfer).

A sheet P stored in a sheet tray 21 of a sheet feeding apparatus 20 is fed by the 1st sheet feeding section 22. The sheet P is conveyed to the secondary transfer roller 9 through the feed rollers 23, 24, 25A and 25B, and registration rollers 26. And a color toner image is secondarily transferred onto the sheet P (secondary transfer).

In addition, since three tiers of sheet trays 21, which are arranged in a vertical column in the perpendicular direction in the lower portion of the image forming apparatus 100 are structured almost the same, so the same symbols are given. Moreover, since three tiers of the sheet feeding sections 22 also are structured almost the same, the same symbols are given. The sheet trays 21 and the sheet feeding sections 22 are to be called a sheet feeding apparatus 20.

The sheet P onto which the color toner image was transferred is interposed in the fixing apparatus 30, and a color toner image is fixed onto the sheet P by applying heat and pressure. Then, the sheet P interposed by a conveying roller pair 37 is conveyed, and is ejected from ejection rollers 27 provided in the ejection conveyance path. Then, the sheet P is placed on the ejection tray 60 provided outside the image forming apparatus.

On the other hand, the residual toner on the intermediate transfer belt 6 is removed by the cleaning section 61 after the secondary transfer rollers 9 transfer a color toner image onto the sheet P.

When copying to both sides of the sheet P, after performing a fixing processing to the toner image formed in the 1st side of the sheet P, the sheet P is branched from an ejection conveyance path with a branch board 29. Then, after the sheet P is guided into a double-sided conveyance path 28 and the sides of the sheet P is reversed, the sheet P is conveyed from feed rollers 25B again. The toner image of each color is formed on the 2nd side of the sheet P by the image forming sections 10Y, 10M, 10C, and 10K. As a result, the toner images are formed on both sides of the sheet P. A heat fixing process is carried out to the sheet P by the fixing apparatus 30, and the sheet P is ejected out of the apparatus by the sheet ejecting rollers 27.

[Voltage Applying Member]

A voltage applying member will be described based on FIG. 2, FIG. 3(*a*) and FIG. 3(*b*). FIG. 2 illustrates an enlarged view of the primarily transferring roller 7 surrounding, and FIGS. 3(*a*)-3(*b*) illustrate enlarged drawings of a voltage applying member 8. The voltage applying member 8 is provided near the intermediate transfer belt moving direction in the lower streamside of the transfer nip N formed between the photoreceptor 1 and the primarily transferring roller. The edge of the voltage applying member 8 is arranged so as to be disposed at several mm to several tens mm in the direction of Y from the lower streamside of the transfer nip N and about several mm in the direction of X. The direction of Y is the transfer member moving direction here, and the direction of X is a direction to intersect perpendicularly to the direction of Y, and is a toner layer side.

Figure 3:
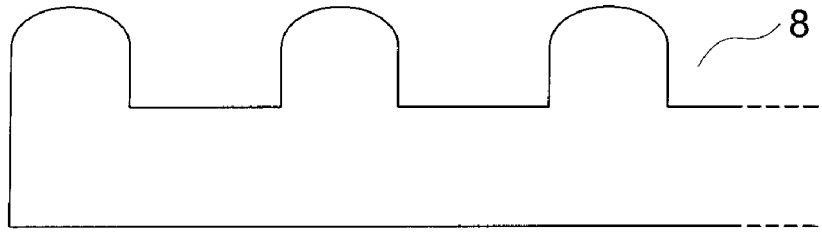
FIG. 3(*a*) illustrates an enlarged drawing of a voltage applying member 8 viewed from the X direction of FIG. 2, and FIG. 3(*b*) illustrates an example of a modification of the voltage applying member 8.
Figure 3:
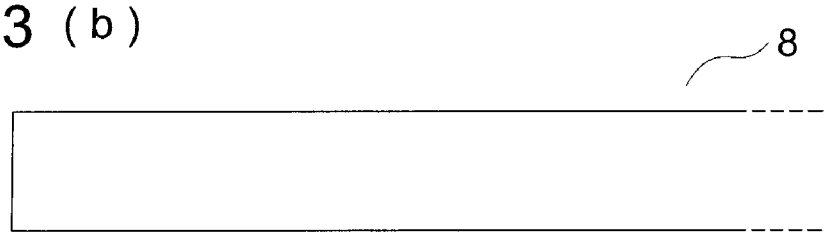

FIG. 3(*a*) illustrates an enlarged drawing of the voltage applying member 8 viewed from the X direction of FIG. 2. As shown in the drawing, at the leading edge of the voltage applying member 8, the semicircle shaped convex section is arranged at equal intervals in a longitudinal direction (shaft direction of the roller). For example, by conducting an etching process of the SUS plate having thickness of 0.1 mm, convex sections are arranged across the whole area of the sheet width direction of the sheet with 1-5 mm fixed pitch. FIG. 3(*b*) illustrates an example of a modification of the voltage applying member 8 having no convex sections. As shown in FIG. 3(*b*), a mere rectangle shaped thin plate of may be used as the voltage applying member 8. In the present invention, it is that the control section 50 controls the power source section 81 to apply voltage to the voltage applying member 8.

In addition, in an embodiment of the present invention, although the example in which the voltage applying member 8 has been arranged near the transfer nip formed by the primarily transferring roller was explained, it is not limited to this. The voltage applying member 8 may be provided in the downstream of the secondary transfer rollers 9 and adjacent thereof. In this case, the intermediate transfer belt 6 functions as "an image carrier". The secondary transfer rollers 9 function as "a transfer section". A sheet will function as "a transfer member".

Furthermore, in the image forming apparatus which forms a color toner image on a sheet by superimposing the toner image from a plurality of photoreceptors onto the sheet, which is electrostatically adsorbed on the transfer conveying belt, by a plurality of transfer nips, the configuration where the voltage applying members are respectively disposed adjacent to the transfer nips on the downstream side may be allowed. In this case, the transfer conveying belt will function as a "transfer section" and the sheet will function as a "transfer member".

Thus, by providing the voltage applying member 8 close to the transfer nip N on the downstream side in the transfer member moving direction of the transfer nip P, rather than (1) the discharge produced between the photoreceptor and the toner layer, onto which the toner image has been transferred from the photoreceptor, on the transfer member, (2) the discharge produced between the photoreceptor and the voltage applying member 8 tends to occur. Namely, by functioning the voltage applying member as a lightning conductor, it becomes possible to cause (1) the discharge of (2) more proactively and to decrease discharge of (1). Eventually, it becomes possible to regulate the image failure due to the uneven charge of the toner layer caused by the discharge of (1).

Moreover, since the predetermined voltage, which does not actively carry out self-discharge to the transfer member, is applied from the voltage applying member 8, a change in the toner layer potential by the discharge disappears. For this reason, an occurrence of an image failure can be suppressed.

There are various kinds of voltage applying methods to derive the effect of the present invention. An embodiment 1, an embodiment 2 and other embodiment will be described in detail.

An embodiment 1 of the present invention will be described hereinafter.

Embodiment 1

The Voltage Applying Method

In this embodiment 1, the power source section 81 outputs the prescribed voltage, which does not carry out self-discharge from the voltage applying member 8, in the same polarity as the charging characteristics of the toner. Since the toner has negative charging characteristic, the voltage of the negative polarity will be outputted as the polarity of the output voltage of the power source section 81. As output voltage, it is preferred that voltage is −200 V to −700 V, and it is further preferred to set the voltage within the limits of from −200 V to −400 V as the prescribed value.

Example 1

In this example 1, the image forming apparatus shown in FIGS. 1, 2, and 3(*a*) was used. The detailed conditions are as follows.

Experimental Condition

Voltage applying member: 0.1 mm of SUS etching thickness, a leading edge position is positioned at 18 mm in the Y directions and 4 mm in the X directions from the transfer nip N (FIG. 2).

Toner: polymer toner with an average particle diameter of 6.5 μm and the amount of toner charge from −40 to −50 μC/g.

Intermediate transfer belt: polyimide semiconductor belt, thickness 80 μm, perimeter 861 mm in length, 362 mm in width, and a surface resistivity from $1.0\times10^{10}$ to $1.0\times10^{11}\Omega/\square$.

Intermediate transfer belt movement speed: 300 mm/sec.

Test environment: 22° C., 50% RH.

Evaluation toner image: a 2-color layered solid image.

Toner layer potential: −200 V.

With respect to the measurement of toner layer potential, the toner layer potential on the intermediate transfer belt 6 has been measured in advance by a non-contact surface potential meter. Moreover, the surface potential of the intermediate transfer belt 6 is about 0 V in case when there is no toner layer.

Experimental Results

The image was evaluated after changing the applied voltage to the voltage applying member 8 from the power source section 81 and secondarily transferring to a sheet. A result is as being shown in Table 1.

TABLE 1

| Power source voltage (V) | Image Quality |
|---|---|
| 0 | C |
| −180 | C |
| −190 | C |
| −200 | B |
| −210 | B |
| −220 | B |
| −230 | A |
| −240 | A |
| −250 | A |
| −300 | A |
| −310 | A |
| −320 | A |
| −330 | A |
| −340 | A |
| −350 | A |
| −360 | B |
| −370 | B |
| −380 | B |
| −390 | B |
| −400 | B |
| −410 | C |
| −420 | C |

A: No image failure due to discharge occurs and image quality is good.
B: Minor image failure due to discharge occurs, however it is a permitted level.
C: The image failure due to discharge occur and no-good (NG) level.

As shown in Table 1, when the absolute value of the applied voltage applied to a voltage applying member is smaller than toner layer potential (−200 V), it can be learned that it is ineffective. Moreover, in reverse, when the absolute value of the applied voltage is too large, it can be learned that the image failure occurs. This is because the spread of the toner has occurred by the voltage applying member. According to the experiment results, it is good to apply the voltage of −200 V to −400 V to the voltage applying member under the condition of toner layer potential of −200 V. Namely, it can be learned that it is preferable to apply the voltage onto which 0 to 200 V is added, to the absolute value of the toner layer potential.

Figure 8:
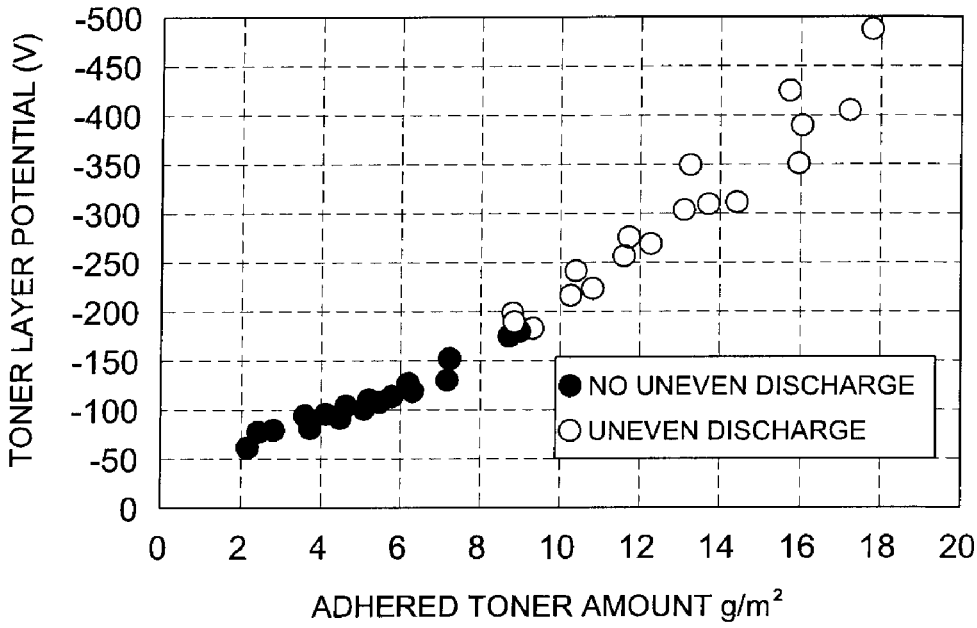
FIG. 8 illustrates the relation between the adhered toner amount per unit area and toner layer potential.
Figure 9:
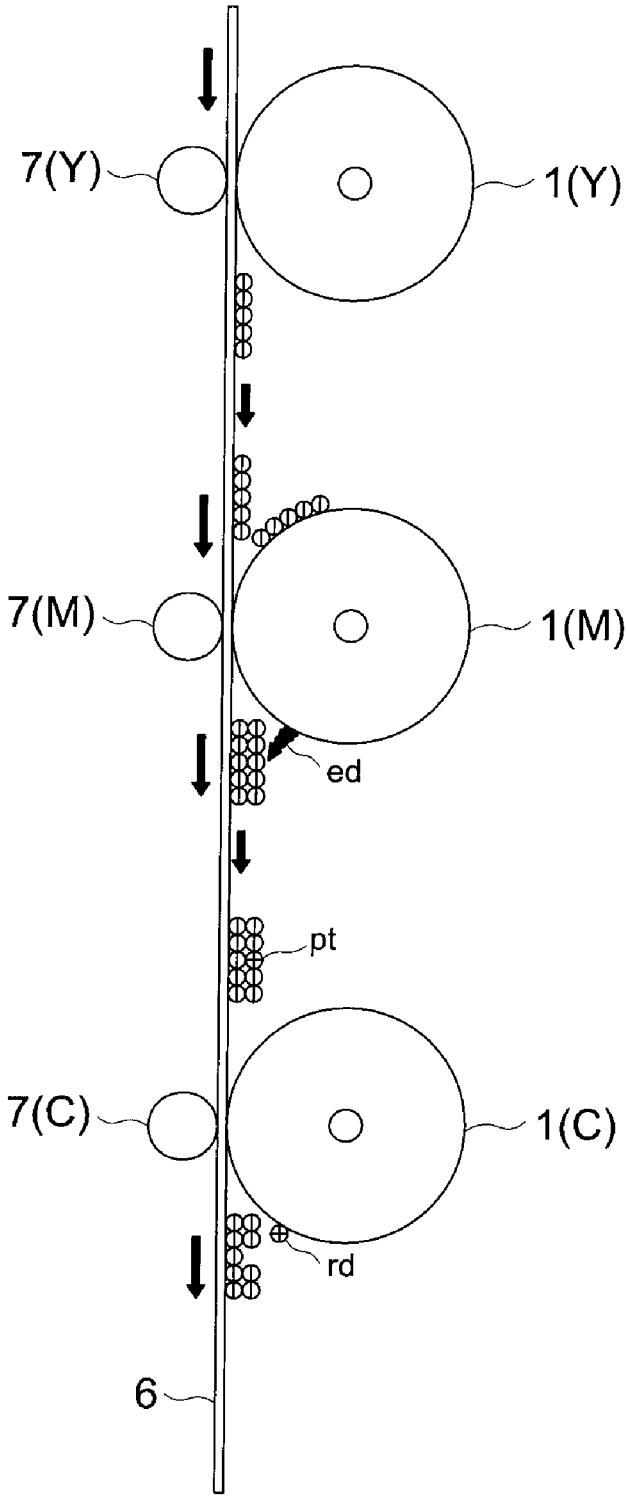
FIG. 9 illustrates a schematic diagram explaining the image failure by the abnormal discharge in a tandem type color image forming apparatus.

FIG. 8 illustrates a figure showing the relation between the toner adhesion amount per unit area and the toner layer potential. It can be learned that the toner adhesion amount and the toner layer potential are in the proportional relation as shown in the figure. Moreover, since the maximum the toner adhesion amount is 18 g/m$^2$ in this embodiment, it can be learned that the upper limit of the toner layer potential is −500 V.

Furthermore, in the figure, the evaluation result of the existence of the image failure occurrence due to the discharge is displayed in case when the voltage applying member is not used along with the relation between the toner adhesion amount per unit area and the toner layer potential. It can be learned that the toner layer potential of the lower limit in which the image failure due to discharge occurs is −180 V from the figure. Therefore, it is preferable that the toner layer potential, which does not generate image failure, is from −180 V to −500 V.

As described above, the voltage range applied to the voltage applying member is preferably within the range of from −180 V to −700 V, which is derived by adding the range of 0 V to −200 V to the range of toner layer potential (−180 V to −500 V). In addition, since the maximum adhered toner amount, namely, the maximum toner layer potential varies by a number of the color toner images to be superimposed, the voltage having a higher absolute value may be applied to the voltage applying member as the number of the color toner image to be superimposed increases. An embodiment 2 of the present invention is described hereinafter.

Embodiment 2

In an embodiment 2, the control section 50 applies the voltage having the same polarity as the charging characteristic of the toner to the voltage applying member. The applied voltage controls the output of the power source section 81 based on the toner layer potential.

[Toner Layer Potential]

In FIG. 2, numeral 11 is a non-contact surface potential meter. The surface potential meter 11 is disposed at the position opposing the photoreceptor 1 in an area a1. The surface potential meter 11 measures the surface potential of the toner layer formed on the photoreceptor 1. And based on the measurements by the surface potential meter 11 in the area a1, the control section 50 estimates the toner layer potential formed on the intermediate transfer belt 6 in an area a2. In addition, a plurality of surface potential meters, for example, three surface potential meters 11, are arranged in a shaft direction of the photoreceptor 1. By measuring the profile of the toner layer potential of the shaft direction, it is possible to obtain the information on the maximum value of the toner layer potential of the shaft direction.

Figure 4:
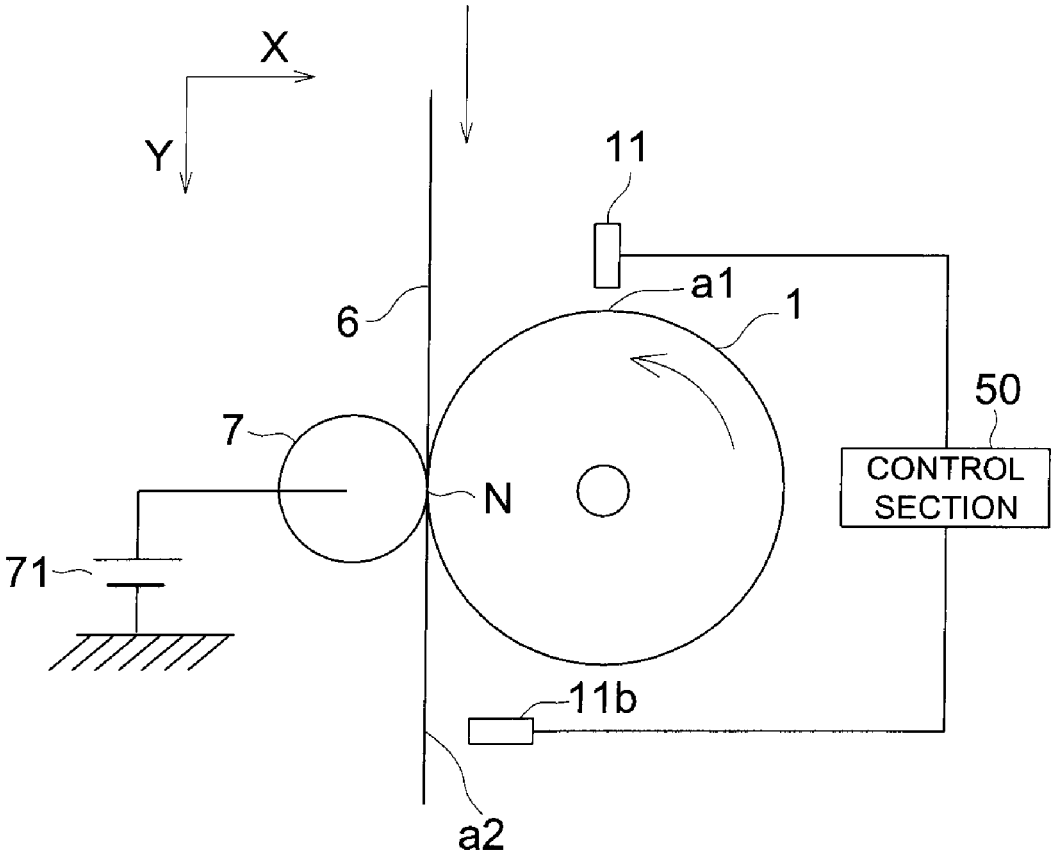
FIG. 4 illustrates a schematic diagram explaining an experiment, which investigates the relation of the toner layer potential in an area a1 and an area a2.

FIG. 4 illustrates a schematic diagram explaining the experiment, which investigates the correlation of the toner layer potential in an area a1 and an area a2. In the experiment, as shown in the FIG. 4, the 2nd surface potential meter 11*b*, in place of the voltage applying member 8, is disposed in the position opposing the intermediate transfer belt 6. In the image forming apparatus of such structure, the correspondence relationship of the toner layer potential in each of an area a1 and an area a2 is examined in the experiment, and the correspondence relationship is stored in the memory of the control section 50 as a correspondence table. It becomes possible to acquire "the information on toner layer potential" on the intermediate transfer belt 6 in an area a2 by the measurements of the surface potential meter 11. In addition, based on the experiment results, several correspondence tables may be provided, which differ with toner color and output values of the humidity sensor inside the apparatus, the humidity sensor detecting the relative humidity and being provided in the image forming apparatus main body.

In addition, the example for acquiring the information on the toner layer potential with the measurements of the surface potential meter 11 was explained. However, it is not limited to this in this embodiment 2. The information on the toner layer potential may be obtained by any one of following (1), (2), or (3) in this embodiment 2.

(1) When developing an image with toner, the toner charge amount developed on the photoreceptor 1 can be estimated by monitoring the current flowing into the photoreceptor 1 from the constant voltage power source connected to the developing roller 40. The converted value of the monitored current value is used as information on the toner layer potential.

(2) The adhered toner amount per unit area of the toner image formed on the photoreceptor 1 is estimated by utilizing the output of the optical density sensor provided in the position opposing the photoreceptor 1. By examining the relationship between the adhered toner amount and the toner layer potential beforehand, the converted value from the output of the optical density sensor is used as information on toner layer potential.

(3) The converted value from the monitor value derived by monitoring the voltage value at the time of transfer of the constant current power source 71 for supplying a transfer current to the primarily transferring roller 7 is used as information on the toner layer potential. Specifically, the adhered toner amount is estimated from the relationship between a transfer current and the voltage at the time of transfer. The toner layer potential is further estimated from the estimated adhered toner amount.

[Control Flow]

Figure 5:
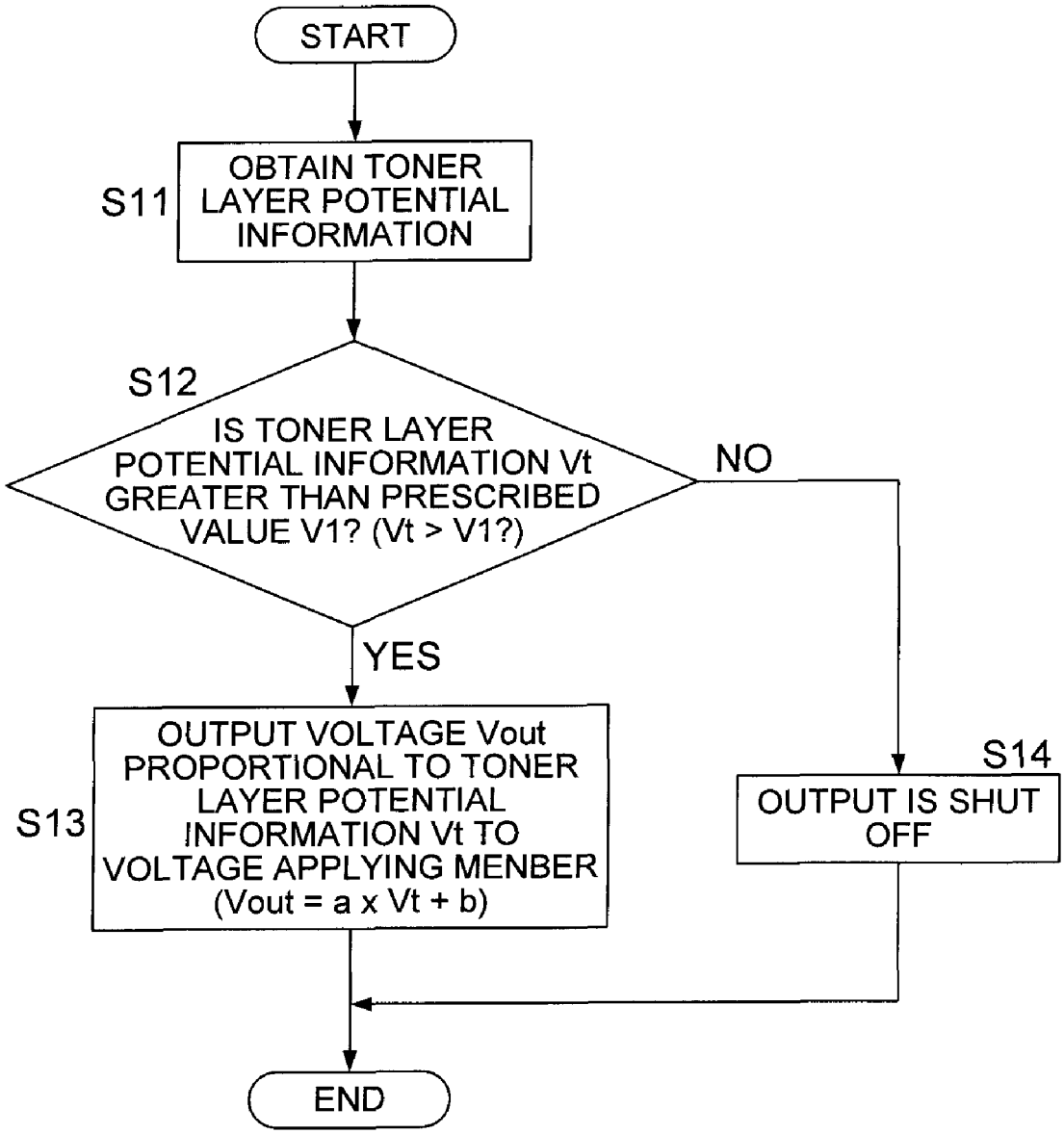
FIG. 5 illustrates a control flow of the image forming apparatus related to an embodiment of the present invention.

FIG. 5 illustrates a control flow of an image forming apparatus related to an embodiment 2 of the present invention. This control flow is a process performed by the control section 50. Firstly, at Step S11, the toner layer potential information is obtained. The acquisition of the toner layer potential information Vt is performed by referring to the correspondence table stored in the memory of the control section 50 in advance based on the measured value of the surface potential meter 11 as aforementioned.

At Step S12, whether the absolute value of the toner layer potential information Vt is greater than the prescribed value V1 is determined. This prescribed value V1 is, for example, −180 V. The image failure due to the discharge between the toner layer and the transfer member 6 hardly occurs in case when this absolute value is less than prescribed value V1.

When the absolute value of the toner layer potential information Vt is greater than the prescribed value V1 (Step S12: Yes), at the following step S13, the voltage proportional to the toner layer potential information Vt is outputted to the voltage applying member 8 from the power source section 81 (Vout). The relation of Vout=a×Vt+b comes in effect here, a and b are constants, for example, a is 1.0, and b is set as −50 V. For example, Vout is set to −250 V when Vt is −200 V.

On the other hand, when the absolute value of the toner layer potential information Vt is less than the prescribed value V1 (Step S12: No), the output of the power source section 81 is turned off by grounding (Step S14), and the process ends (END).

As described above, by performing on/off control of the power source section 81*b* which supplies voltage to the voltage applying member 8*b* based on the information on the toner layer potential, it becomes possible to control the image failure caused by the uneven charge of the toner layer without new image failure generated based on unnecessary discharging.

Example 2

Next, the embodiment 2 of the present invention will be described. The image forming apparatus shown in FIGS. 1 to 3(*b*) was used in Embodiment 2. The detailed conditions are as follows.

Experimental Condition 1

Voltage applying member: 0.1 mm of SUS etching thickness, a leading edge position is positioned at 18 mm in the Y directions and 4 mm in the X directions from the transfer nip N (FIG. 2).

Toner: polymer toner with an average particle diameter of 6.5 μm and the amount of toner charge from −40 to −50 μC/g.

Intermediate transfer belt: polyimide semiconductor belt, thickness 80 μm, perimeter 861 mm in length, 362 mm in width, and a surface resistivity from $1.0\times10^{10}$ to $1.0\times10^{11}\Omega/\square$.

Intermediate transfer belt movement speed: 300 mm/sec.

Test environment: 22° C., 50% RH.

With respect to the measurement of toner layer potential, the toner layer potential on the intermediate transfer belt 6 has bee measured in advance by a non-contact surface potential meter lib (refer to FIG. 4). Moreover, the surface potential of the intermediate transfer belt 6 is about 0 V in case when there is no toner layer.

Experimental Result 1

FIG. 8 illustrates the relation between the adhered toner amount per unit area and toner layer potential. As shown in the FIG. 8, shows the proportional relation between the adhered toner amount and the toner layer potential. Furthermore, in the figure, the evaluation result of the existence of the image failure occurrence due to the discharge is displayed in case when the voltage applying member 8 is not used along with the relation between the toner adhesion amount per unit area and the toner layer potential. It can be learned that the toner layer potential of the lower limit in which the image failure due to discharge occurs is −180 V from the figure. From this, the prescribed value V1 (Step S12 of FIG. 5) was set as −180 V.

Experimental Result 2

Under the conditions of the experiment condition 1, the image formed on the sheet was evaluated by changing the applied voltage to the voltage applying member 8 from the power source section 81 having the toner layer potential under a certain condition at −200 V. The result is as being shown in Table 2.

TABLE 2

| Power source voltage (V) | Image quality |
|---|---|
| 0 | C |
| −180 | C |
| −190 | C |
| −200 | B |
| −210 | B |
| −220 | B |

TABLE 2-continued

| Power source voltage (V) | Image quality |
|---|---|
| −230 | A |
| −240 | A |
| −250 | A |
| −300 | A |
| −310 | A |
| −320 | A |
| −330 | A |
| −340 | A |
| −350 | A |
| −360 | B |
| −370 | B |
| −380 | B |
| −390 | B |
| −400 | B |
| −410 | C |
| −420 | C |

The evaluation criteria in the table are as follows (Table 3 or Table 5 is also the same).
A: No image failure due to discharge occurs and image quality is good.
B: Minor image failure due to discharge occurs, however it is a permitted level.
C: The image failure due to discharge occur and no-good (NG) level.

As shown in Table 2, when the absolute value of the applied voltage applied to the voltage applying member is smaller than the toner layer potential, it can be learned that it is ineffective. Moreover, in reverse, when an applied voltage absolute value is too large, it can be learned that the image failure has occurred. This is because the spread of the toner has occurred by the voltage applying member. It can be learned that it is preferable to apply the voltage of from −200 V to −400 V to the voltage applying member under the condition of the toner layer potential of −200 V. It is further preferable to apply the voltage of −230 V to −350 V to the voltage applying member.

This shows that a constant "a" is preferably 1.0 in case when a constant "b" (in the Step S13 in FIG. 5) is from 0 to −200 V. It is further preferable that the constant "b" is from −30 to −150 V.

Namely, it can be learned that it is preferred to apply the voltage, onto which 0 to 200 V is added, to the absolute value of toner layer potential.

Experiment Result 3

Based on the results of experiment 1 and experiment 2, the prescribed value V1 was set at −180 V, the constant "a" was set at −1.0, and Constant b was set at −50 V. When the voltage, which is proportional to the toner layer potential on the intermediate transfer belt 6, was applied to the voltage applying member 8 under such condition, evaluation of the image formed on the sheet was performed as contrasted with the comparative example result is as being shown in a table 3.

TABLE 3

| | Example | | Comparative example | |
|---|---|---|---|---|
| Toner layer potential (V) | Image quality | Applied voltage (V) | Image quality | Applied voltage (V) |
| −80 | A | Off | A | Off |
| −100 | A | Off | A | Off |
| −120 | A | Off | A | Off |
| −140 | A | Off | A | Off |
| −160 | A | Off | A | Off |
| −180 | A | −230 | B | Off |

TABLE 3-continued

| | Example | | Comparative example | |
|---|---|---|---|---|
| Toner layer potential (V) | Image quality | Applied voltage (V) | Image quality | Applied voltage (V) |
| −200 | A | −250 | B | Off |
| −220 | A | −270 | C | Off |
| −240 | A | −290 | C | Off |
| −260 | A | −310 | C | Off |
| −280 | A | −330 | C | Off |
| −300 | B | −350 | C | Off |
| −320 | B | −370 | C | Off |
| −340 | B | −390 | C | Off |
| −360 | B | −410 | C | Off |
| −380 | B | −430 | C | Off |
| −400 | B | −450 | C | Off |

As shown in Table 3, the area in which image failure does not occur was able to be expanded compared to the comparative example, which does not apply voltage to the voltage applying member 8. In addition, as for the toner layer potential, the image quality of the permitted level (B evaluation) can be maintained down to −400 V.

Example 3

Next, an Example 3 of the present invention will be described. The image forming apparatus shown in FIGS. 1 and 6 was used in the Example 3. The experiment condition is as follows. Only the different conditions from the above-mentioned experimental condition 1 will be described.

Experimental Condition 2

Voltage applying member: a corotron electrode, tungsten wire 60 μm in diameter, 7.5 mm of maximum proximity distance between a wire and a side plate, and a back plate, and a wire position is set at 18 mm in the Y directions and 4 mm in the X directions from the transfer nip (FIG. 2).

The AC power source section 81*b*: DC voltage 0 V, AC frequency of 0.5 kHz.

Experiment Result 4

The image formed on the sheet was evaluated by changing the applied voltage to the voltage applying member 8 from the AC power source section 81*b* in the different toner layer potentials under the conditions of the experiment condition 2. The results are as being shown in Table 4.

TABLE 4

| Toner layer voltage | Applied voltage, AC voltage kVp-p | | | | | | | | | | |
|---|---|---|---|---|---|---|---|---|---|---|---|
| (V) | 0.0 | 2.0 | 4.0 | 5.0 | 6.0 | 6.5 | 7.0 | 7.5 | 8.0 | 8.5 | 9.0 |
| −200 | C | C | C | C | B | A | A | A | A | A | B |
| −250 | C | C | C | C | B | B | A | A | A | A | B |
| −300 | C | C | C | C | B | B | A | A | A | A | A |
| −350 | C | C | C | C | B | B | B | A | A | A | A |
| −400 | C | C | C | C | B | B | B | A | A | A | A |
| −450 | C | C | C | C | B | B | B | A | A | A | A |

As shown in Table 4, no improvement effect was obtained with the output of not more than 5.0 kVp-p of AC voltage.

This is considered to be because of the self-discharge from the voltage applying member 8*b* has hardly occurred or because of the discharge electric charge amount to the intermediate transfer belt 6 being insufficient. In addition, in AC voltage 9.0 kVp-p, the level is getting worse conversely. This is considered to be based on superfluous discharge. Based on this, the lower limit of the AC voltage under which the image failure does not occur within the range of the toner layer potential of −200 to −450 V, which is shown in Table 4, is 7.5 kVp-p. According to this, the prescribed AC voltage was set at 7.5 kVp-p.

Experiment Result 5

Based on the result of experiment 1 and experiment 4, the prescribed value V1 was set to −180 V, and prescribed AC voltage was set to 7.5 kVp-p. When on/off control of the AC power source section 81*b* was performed to the voltage applying member 8*b* based on the toner layer potential on the intermediate transfer belt 6 under such condition, the evaluation of the image formed on the sheet was performed as contrasted with the comparative example. The result is as being shown in Table 5.

TABLE 5

| | Example | | Comparative example | |
|---|---|---|---|---|
| Toner layer potential (V) | Image quality | Applied voltage (kVp-p) | Image quality | Applied voltage |
| −80 | A | Off | A | Off |
| −100 | A | Off | A | Off |
| −120 | A | Off | A | Off |
| −140 | A | Off | A | Off |
| −160 | A | Off | A | Off |
| −180 | A | 7.5 | B | Off |
| −200 | A | 7.5 | B | Off |
| −220 | A | 7.5 | C | Off |
| −240 | A | 7.5 | C | Off |
| −260 | A | 7.5 | C | Off |
| −280 | A | 7.5 | C | Off |
| −300 | A | 7.5 | C | Off |
| −320 | A | 7.5 | C | Off |
| −340 | A | 7.5 | C | Off |
| −360 | A | 7.5 | C | Off |
| −380 | A | 7.5 | C | Off |
| −400 | A | 7.5 | C | Off |

As shown in Table 5, a domain, which the image failure does not occur, was able to expanded compared to the comparative example, which does not apply voltage to the voltage applying member 8*b*. Further, with respect to the toner layer potential, it becomes possible to keep image quality down to −400 V.

Other Embodiment

Figure 6:
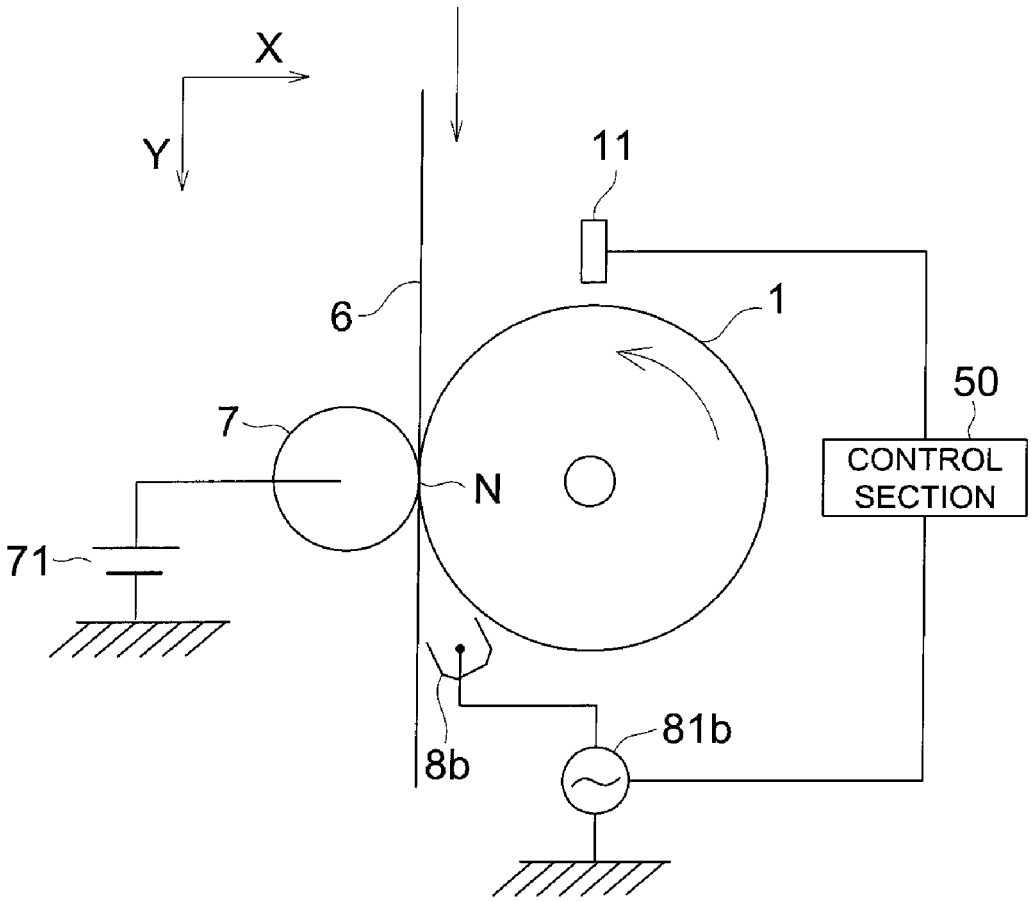
FIG. 6 illustrates an enlarged drawing of the primary transfer roller 7 surrounding in the image forming apparatus related to other embodiments.
Figure 7:
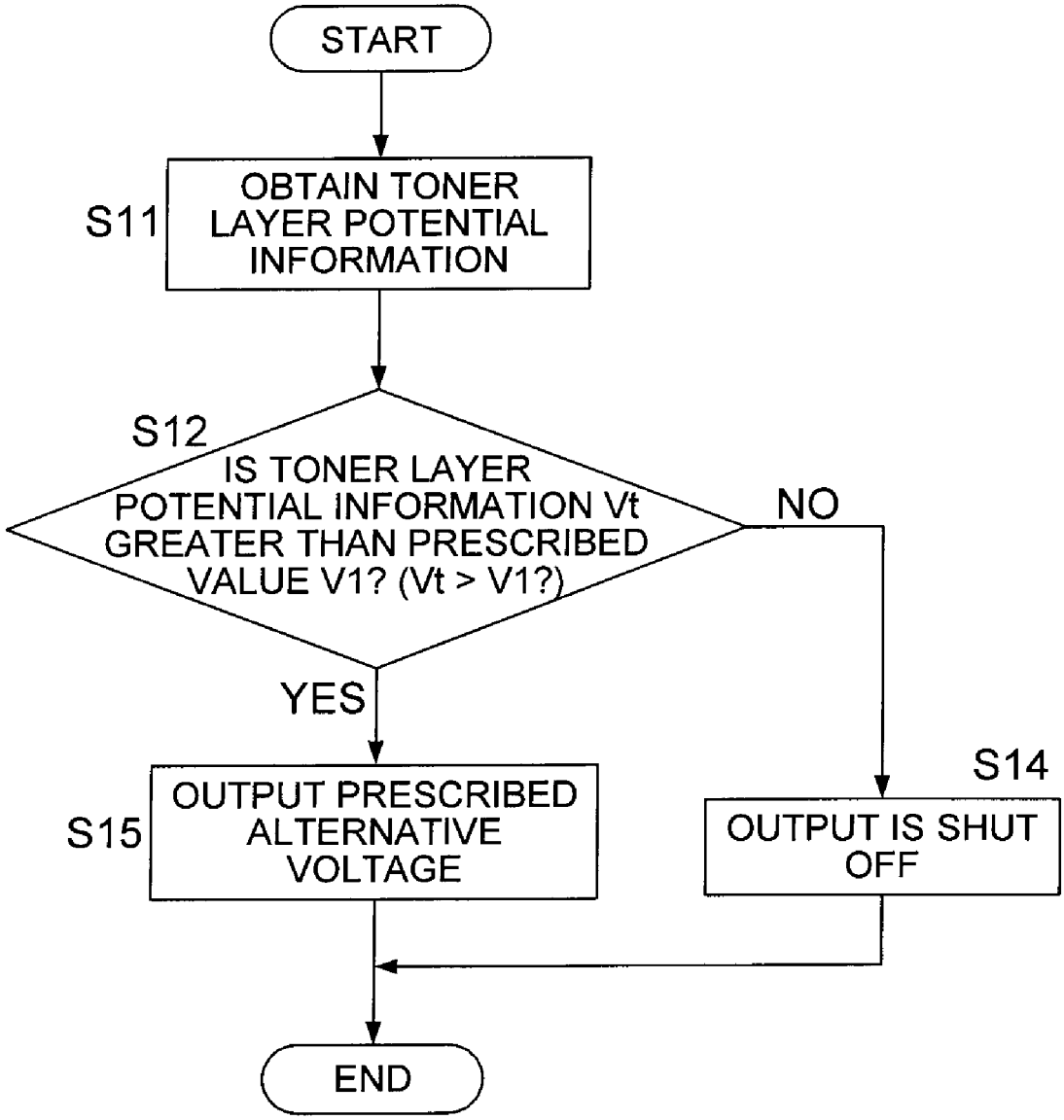
FIG. 7 illustrates the control flow of the image forming apparatus related to other embodiments.

Other embodiment is explained based on FIG. 6 and FIG. 7. FIG. 6 illustrates an enlarged drawing in the periphery of the primary transfer roller 7 in the image forming apparatus related to other embodiments. In the FIG. 6, the voltage applying member 8*b* of a corotron electrode is used and the power source section is the AC power source section 81*b* for outputting the alternative voltage not a DC constant voltage power source. With respect to the other structure, other than this, the structure is the same as the structure shown in FIG. 1 and FIG. 2.

FIG. 7 illustrates the control flow of the image forming apparatus related to other embodiments. In the control flow, when the absolute value of toner layer potential information Vt is greater than prescribed value V1 in Step S12 (Step S12: Yes), at the following step S15, prescribed AC voltage is outputted to voltage applying member 8*b* from the AC power supply section 81*b*, and process ends (END). Other control flows are the same as that of FIG. 5, and explanation will be omitted. In the embodiment of the present invention, for example, the output with a frequency of 0.3 to 2.0 kHz at 7.5 kV is performed as an AC voltage value. It may also be possible to output a voltage having the DC voltage superimposed onto the AC voltage. It may also be possible to gradually increase the AC voltage along with the increase of the absolute value of the toner layer potential.

According to the present invention, the image failure produced by the uneven charge of the toner layer on the transfer member can be suppressed. It becomes possible to suppress the image failure caused by the uneven charge of the toner layer without producing a new image failure due to the unnecessary discharge.

What is claimed is:

1. An image forming apparatus which forms a toner image, comprising:

(a) an image carrier which carries the toner image thereon;

(b) a transfer section which interposes a transfer member at a transfer nip between the image carrier and the transfer section thereby to transfer the toner image on the image carrier onto the transfer member;

(c) a voltage applying member provided downstream of the transfer nip in a moving direction of the transfer member;

(d) a power source section which applies a voltage to the voltage applying member; and (e) a control section which controls the voltage applied by the power source section, wherein the control section controls the power source section to apply a prescribed voltage to the voltage applying member so that the prescribed voltage has the same polarity as that of a toner used in the apparatus and the voltage applying member does not carry out a self-discharge to the transfer member.

2. The image forming apparatus of claim 1, wherein the prescribed voltage is higher than a potential of a toner layer deposited on the transfer member.

3. The image forming apparatus of claim 1, wherein the prescribed voltage is −180 V to −700 V.

4. The image forming apparatus of claim 2, wherein the potential of the toner layer is −180 V to −500 V.

5. The image forming apparatus of claim 1, wherein the image carrier comprises a plurality of image carriers each which carries a color toner image, a color of which is different from each other, wherein the transfer member is an intermediate transfer belt on which each of the toner image on the plurality of image carriers is transferred and thereby superimposed toner images are formed.

6. An image forming apparatus which forms a toner image, comprising:

(a) an image carrier which carries the toner image thereon;

(b) a transfer section which interposes a transfer member at a transfer nip between the image carrier and the transfer section thereby to transfer the toner image on the image carrier onto the transfer member;

(c) a voltage applying member provided downstream of the transfer nip in a moving direction of the transfer member;

(d) a power source section which applies a voltage to the voltage applying member; and (e) a control section which controls the voltage applied by the power source section, wherein the control section controls the power source section to apply a voltage to the voltage applying member, which is the same polarity as that of a toner used in the apparatus and is proportional to a potential of a toner layer on the transfer member.

7. The image forming apparatus of claim 6, wherein the control section controls turn-on and turn-off of the power source section based on the potential of the toner layer on the transfer member.

8. The image forming apparatus of claim 6, wherein when an absolute value of the potential of the toner layer on the transfer member is less than a prescribed value, the control section turns off an output of the power source section and does not apply a voltage to the voltage applying member.

9. The image forming apparatus of claim 6, wherein the applied voltage includes an alternate voltage component.

10. The image forming apparatus of claim 6, wherein the image carrier comprises a plurality of image carriers each which carries a color toner image, a color of which is different from each other, the transfer member is an intermediate transfer belt on which each of the toner image on the plurality of image carriers is transferred and thereby superimposed toner images are formed.

* * * * *